US006159086A

United States Patent [19]

McClurkin

[11] Patent Number: 6,159,086

[45] Date of Patent: Dec. 12, 2000

[54] DUST COLLECTING WORK STATION

[76] Inventor: Walter J. McClurkin, 105 E. Beech St., Yakima, Wash. 98901

[21] Appl. No.: 09/119,378

[22] Filed: Jul. 20, 1998

[51] Int. Cl.[7] ..... B24B 55/04

[52] U.S. Cl. ..... 451/453; 451/451; 451/456

[58] Field of Search ..... 451/451, 453, 451/456, 87, 88

[56] References Cited

U.S. PATENT DOCUMENTS

| | | | |
|---|---|---|---|
| 1,896,772 | 2/1933 | Drespel . | |
| 3,594,958 | 7/1971 | Cusumano | 51/170 |
| 3,720,021 | 3/1973 | Wada | 51/281 |
| 4,120,121 | 10/1978 | Surman . | |
| 4,133,658 | 1/1979 | Callewyn | 55/315 |
| 4,184,251 | 1/1980 | Kuboki | 433/29 |
| 4,333,745 | 6/1982 | Zeanwick . | |
| 4,824,083 | 4/1989 | Cattani | 269/15 |
| 5,218,790 | 6/1993 | Huang | 51/170 |
| 5,263,504 | 11/1993 | Bailey et al. | 134/176 |
| 5,470,466 | 11/1995 | Schaaf . | |
| 5,529,533 | 6/1996 | Kantrowitz et al. | 451/456 |
| 5,545,076 | 8/1996 | Yun et al. | 451/287 |
| 5,620,361 | 4/1997 | Aylesworth . | |
| 5,971,839 | 10/1999 | Schmelzer . | |

*Primary Examiner*—Timothy V. Eley
*Assistant Examiner*—Willie Berry, Jr.
*Attorney, Agent, or Firm*—Stratton Ballew PLLC

[57] ABSTRACT

A method and apparatus for a dust collecting work station that utilizes a positive pressure air flow to entrap particulate material from within the work station. The dust collecting work station is especially suited for use by dental technicians, goldsmiths and jewelers. The work station can be economically manufactured, operated with typically available compressed air supply, and can be constructed to fit upon a table top. The dust collecting work station includes a collection base with a back shield that together enclose a work area. A positive pressure air flow is provided to the work area for removing particulate material by impacting the particulate with the positive pressure air flow. A filter media positioned proximately to the collection base entrains the particulate material that is knocked down by the positive pressure air flow. The positive pressure airflow can be supplied by a nozzle located proximate to the face of a user or supplied by a nozzle located proximate to the back shield. Additionally, a settling tray can be employed to collect the suspended particulate material generated from a grinding, deburring or a similar material processing operation by the user on a metallic or ceramic object.

8 Claims, 14 Drawing Sheets

DUST COLLECTING WORK STATION

TECHNICAL FIELD

The invention relates to a dust collecting work station, and more particularly to a method and apparatus for a dust collecting work station that utilizes a positive pressure air flow to entrap part particulate materials generated within the work station.

BACKGROUND OF THE INVENTION

Custom or "one-of-a kind" ceramic and metallurgical work requiring precise and artistic manipulations of small items, often involves delicate, manual manipulations, usually with the aid of high precision tools. An example of such a fine motor task is very evident in manufactured dental work of all types, including dentures, crowns and bridge works. The manufacture or modification of small, custom dental components with highly specific tolerances requires work benches or work stations that are functionally designed for the task.

Additionally, the materials employed for projects of these types, especially fine dental work, are often precious and any waste results in a significant potential for lost revenue. Gold, platinum and silver are typical metals employed for such fine dental work and jewelry work. The efficient dental technician, goldsmith or jeweler must recover as much of these precious metals as practicable.

Also additionally, the generation of dust, be it precious or not, may constitute a respiratory hazard to the worker. A wide variety of masks and vacuum systems are available to minimize such impacts, and many systems have collection mechanisms for the recovery of valuable dusts and waste chips generated.

An early example of a dental work area is found in U.S. Pat. No. 1,896,772 to Drespel, which shows a dental slab or work table having funnel shaped cavities for the collection of materials from the slab. Drespel '772 relies on gravity flow and is directed primarily to liquid material recovery, and so fails to teach the use of air to direct the flow of material to the slab.

The U.S. Pat. No. 4,184,251 to Kuboki shows an instrument of processing artificial teeth that also includes a gravity collection system for the grindings produced. Like Drespel '772, Kuboki '251 also fails to include an air conveying system for trapping grindings and relies only on deflection and gravity to collect them. For trapping and collecting smaller, valuable grindings and also respirable dusts, an air circulation system is needed.

An advance in the area of air circulating work benches is shown in U.S. Pat. No. 4,824,083 to Cattani discloses a work bench for dental technicians and goldsmiths that includes a cowl and a suction system to entrap particulate generated from the work performed within the work bench area. A problem with Cattani '083, which is a typical problem found in all devices that employ suction systems for particulate collection, is that the device requires a high efficiency particulate filtering system external to the work bench. The initial expense and operational noise associated with such systems are discouraging too many potential users. A work bench is needed for dental technicians, goldsmiths and jewelers that does not require an elaborate suction and collection system.

Another example of a suction dental work table is found in U.S. Pat. No. 5,529,533 to Kantrowitz et al., which discloses a portable work bench attachment equipped with a suction tube. Like Cattani '083, Kantrowitz et al. '533 requires an external vacuum source to remove material from the work table. A failing in Kantrowitz et al. '533 is the lack of a collection mechanism for the vacuum.

A small, table top work station that includes an efficient and economical air flow dust collection system is needed. Such a work station must have the ability to entrap salvageable particulate and additionally provide some measure of respiratory protection for the user of the system.

SUMMARY OF INVENTION

The invention provides a method and apparatus for a dust collecting work station that utilizes a positive pressure air flow to entrap particulate material from within the work station. The dust collecting work station of the present invention can be economically manufactured, operated with typically available compressed air supply and can be constructed to fit upon a table top.

In a preferred embodiment of the invention, a collection base is provided with a back shield positioned approximately above the collection base. The back shield and the collection base at least partially enclose a work area. Additionally, a positive pressure air flow is provided to the work area. This positive pressure air flow removes particulate material from the work area by impacting the particulate. A filter media positioned proximately to the collection base entraps the particulate material that is knocked down by the positive pressure air flow and prevents the particulate material from becoming re-entrained into the work area. The positive pressure airflow can be supplied by a nozzle located proximate to the face of a user or supplied by a nozzle located proximate to the back shield.

Additionally, a settling tray can be employed to collect the suspended particulate material. The settling tray is located proximate to the collection base. The filter media can then be located upon the settling tray, and the particulate material falls out of the filter media, undisturbed by the positive pressure air flow.

In a preferred method of the invention, a work area is provided that is at least partially enclosed. Then, a particulate material is generated within the work area by the user. This particulate material is generated from a grinding, deburring or a similar material processing operation by the user on a metallic or ceramic object. As the particulate material is generated by the user, a positive pressured air flow is utilized to impact the particulate material. The impacted particulate is knocked into a filter media where it falls out for recovery by the user.

DETAILED DESCRIPTION OF SPECIFIC EMBODIMENTS

Figure 1:
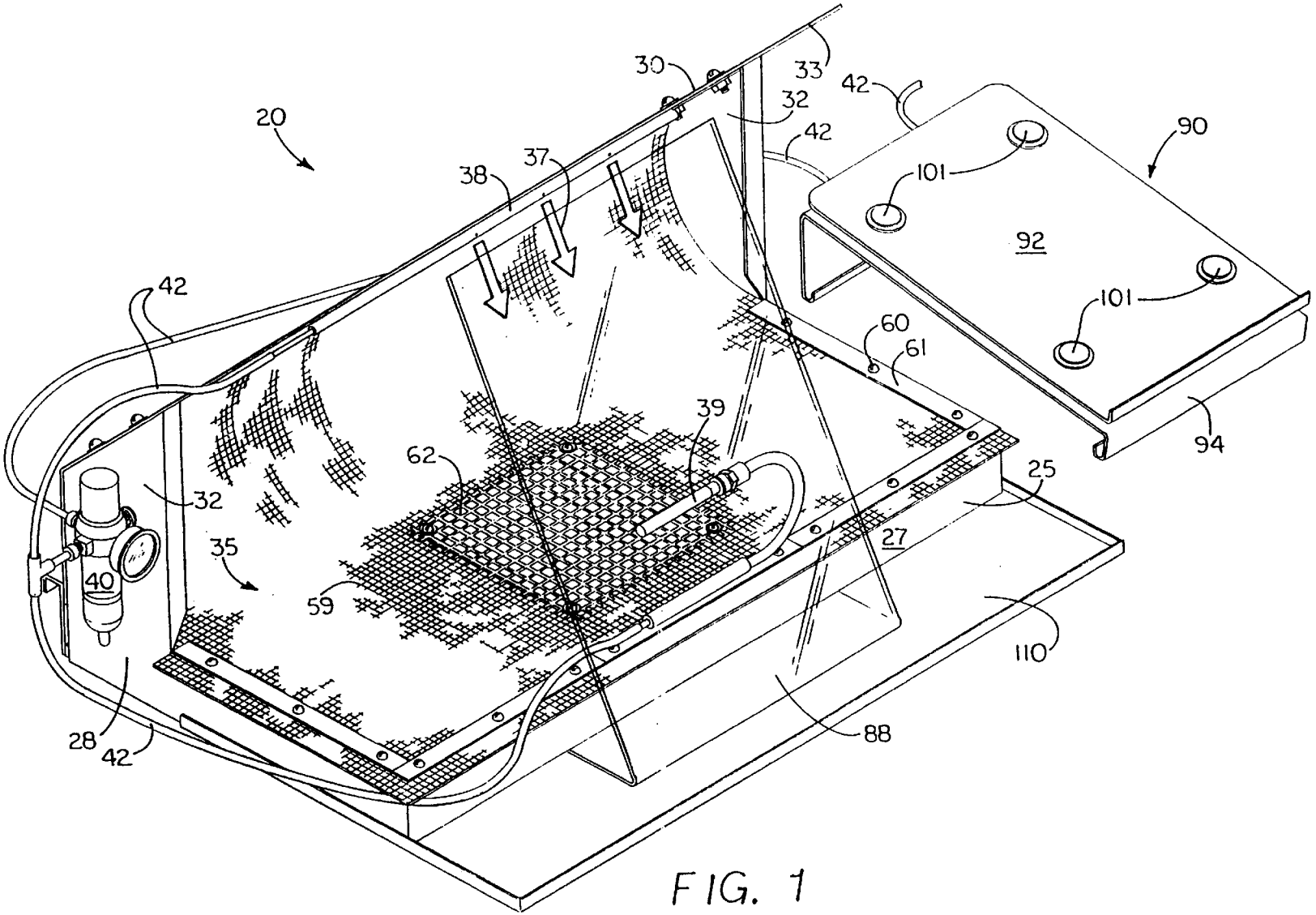
FIG. 1 is a front perspective view of a dust controlling work station, according to an embodiment of this invention.

The present invention comprises a dust collecting work station that is self-contained and is especially suited to the capture of grinding and deburring particulates that are generated by a user's modification of small metal, porcelain or ceramic components. The dust collecting work station is preferably a small, table top enclosure that includes a system of positive air flows to entrain and collect the generated particulate.

A preferred embodiment of the invention is shown in FIGS. 1 through 16. The dust collecting work station 20 includes a collection base 25 that is preferably attached to a back shield 30. The collection base included a front edge and a rear 28. The collection base is preferably formed from a light gauge sheet metal. The back shield, as detailed in FIG. 2, is positioned approximately above the collection base. The back shields is preferably formed from a clear, scratch and shatter resistant plastic material, such as lexan or plexiglass. The back shield can be mounted to the collection base with back screws 29. The back screws attach the back shield to a pair of side extensions 32, which extend upward from the rear of the collection base. The back shield also includes a top edge 33 that preferably angles toward a user of the dust collecting work station.

Figure 2:
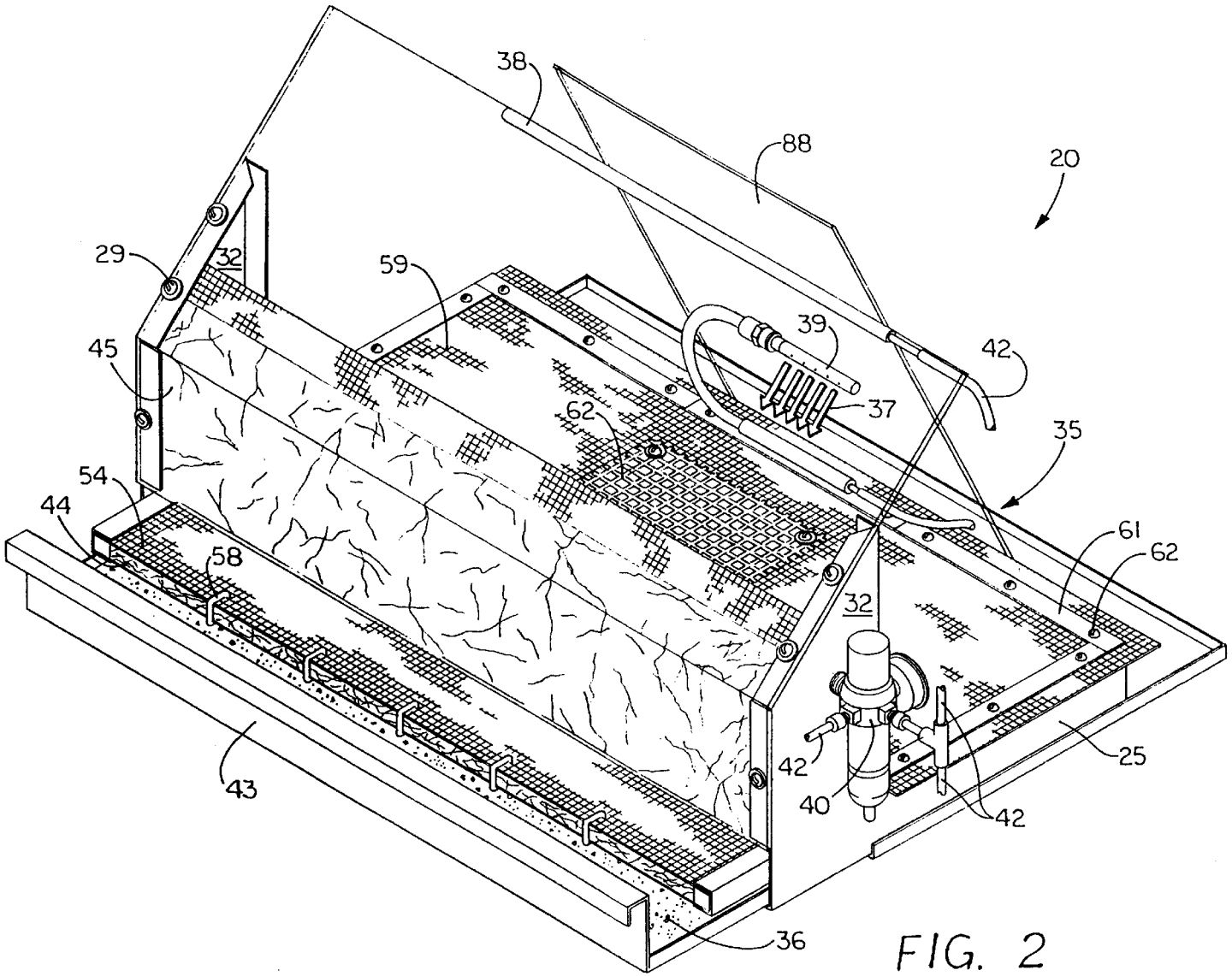
FIG. 2 is a rear perspective view of the dust controlling work station.

As shown in FIGS. 1 and 2, the back shield 30 and the collection base 25 at least partially enclose a work area 35. The work area is provided for the user to perform work operations, such as deburring or grinding, that typically generates a particulate material 36. The present invention is especially suited for work operations that involve precise and fine motor tasks, especially tasks that are often required in the manufacture of small components with highly specified tolerances, or manufactured dental work of all types, including dentures, crowns and bridge works.

Additionally, as shown in FIGS. 1 and 2, a positive pressure air flow 37, denoted by directional arrows, is provided to the work area 35. The positive pressure air flow is preferably distributed to the work area through nozzles mounted on the dust collecting work station. FIG. 1 shows a back shield nozzle 38, mounted on the top edge 33 of the back shield 30 and FIG. 2 shows a front nozzle 39, mounted proximately to the front edge 27 of the collection base 25. The positive pressure air flow is preferably in the range of 20 to 30 psig, however higher and lower pressure air flows are considered by the inventor and directly depend upon the volume of the work area, the design and configuration of air distribution to the work area, and importantly, the nature of the particulate being generated within the work area by the user.

A regulator 40 is utilized to maintain the positive pressure air flow at a consistent flow. The regulator can also include an oil separator and a filter to remove water, oil and other impurities from the air supplied by a compressed air source (not shown). The Miniature Series B-548 Air Filter Gauge, manufactured by Watts Fluid Air Co. of Kittery Me. performs adequately. The air supplied by the compressed air source is delivered to the regulator through an air supply line 42. The positive pressure air flow removes a particulate material 36 from the work area by impacting the particulate material that is generated by the user's operations. The particulate material is shown in FIG. 2, as ultimately collected within a settling tray 43.

The positive pressure air flow 37 impacts the particulate material 36 generated within the work area 35 to force the particulate material toward the collection base 25 and back shield 30. A filter media, positioned proximately to the collection base, entrains the particulate material that is knocked down by the positive pressure air flow. As shown in FIG. 2, the filter media preferably includes a main filter media 44, located in the collection base, and a back filter media 45, located adjacent to the collection base, between the side extensions 32, on the back shield. The filter media is preferably a conventional air filtering media, cut-down and so modified to fit within the dust collecting work station as required. Most preferably, standard efficiency glass fiber mesh media is utilized. However, mineral wools and plastic meshes are also considered as alternatives.

The main filter media 44 and the back filter media 45 preferably act as a barrier to the positive pressure air flow 37, preventing the particulate material 36 that has been collected within the settling tray 43 from becoming re-entrained up into the work area 35.

Figure 5:
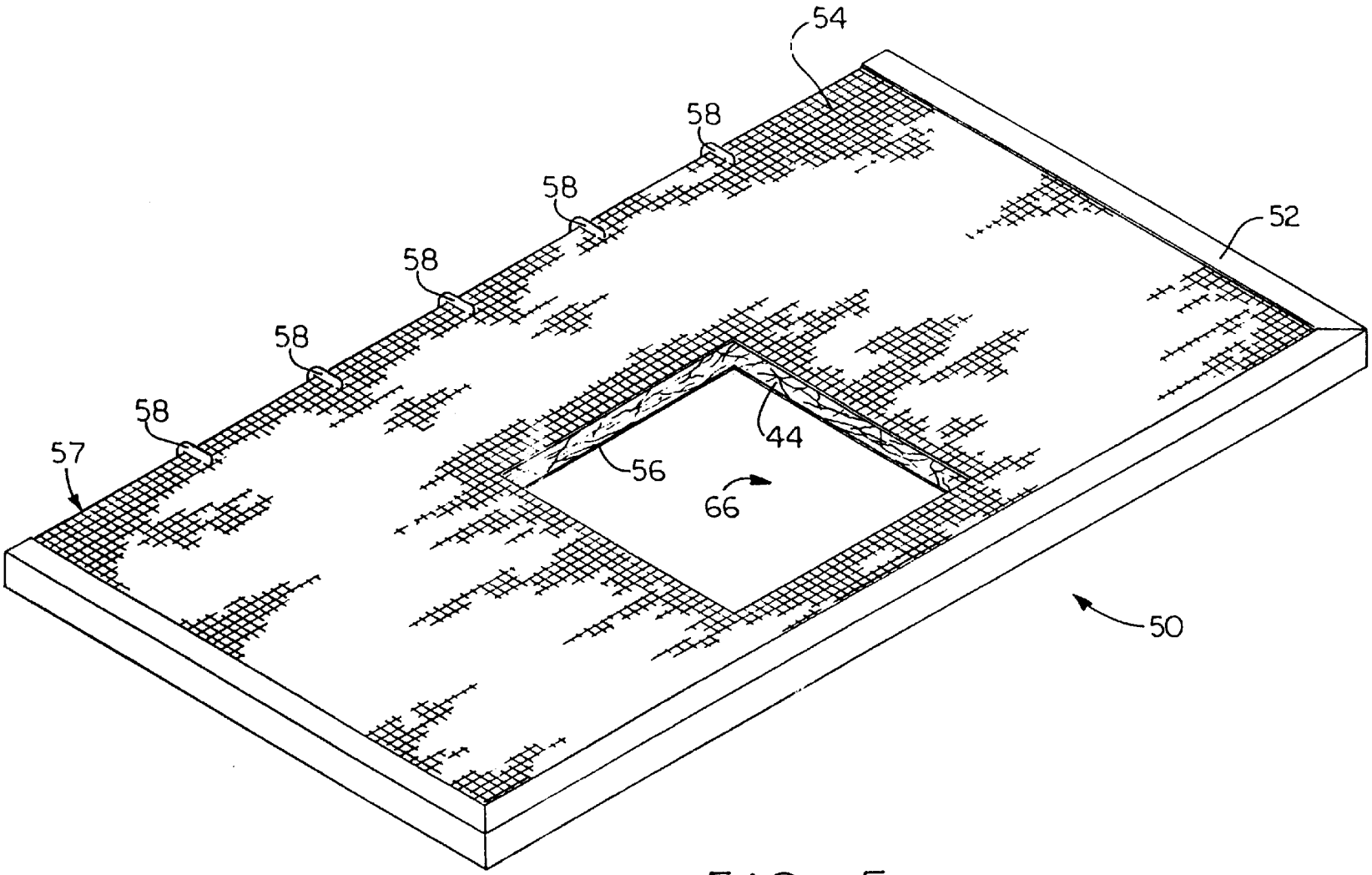
FIG. 5 is a perspective view of a portion of the dust controlling work station.
Figure 6:
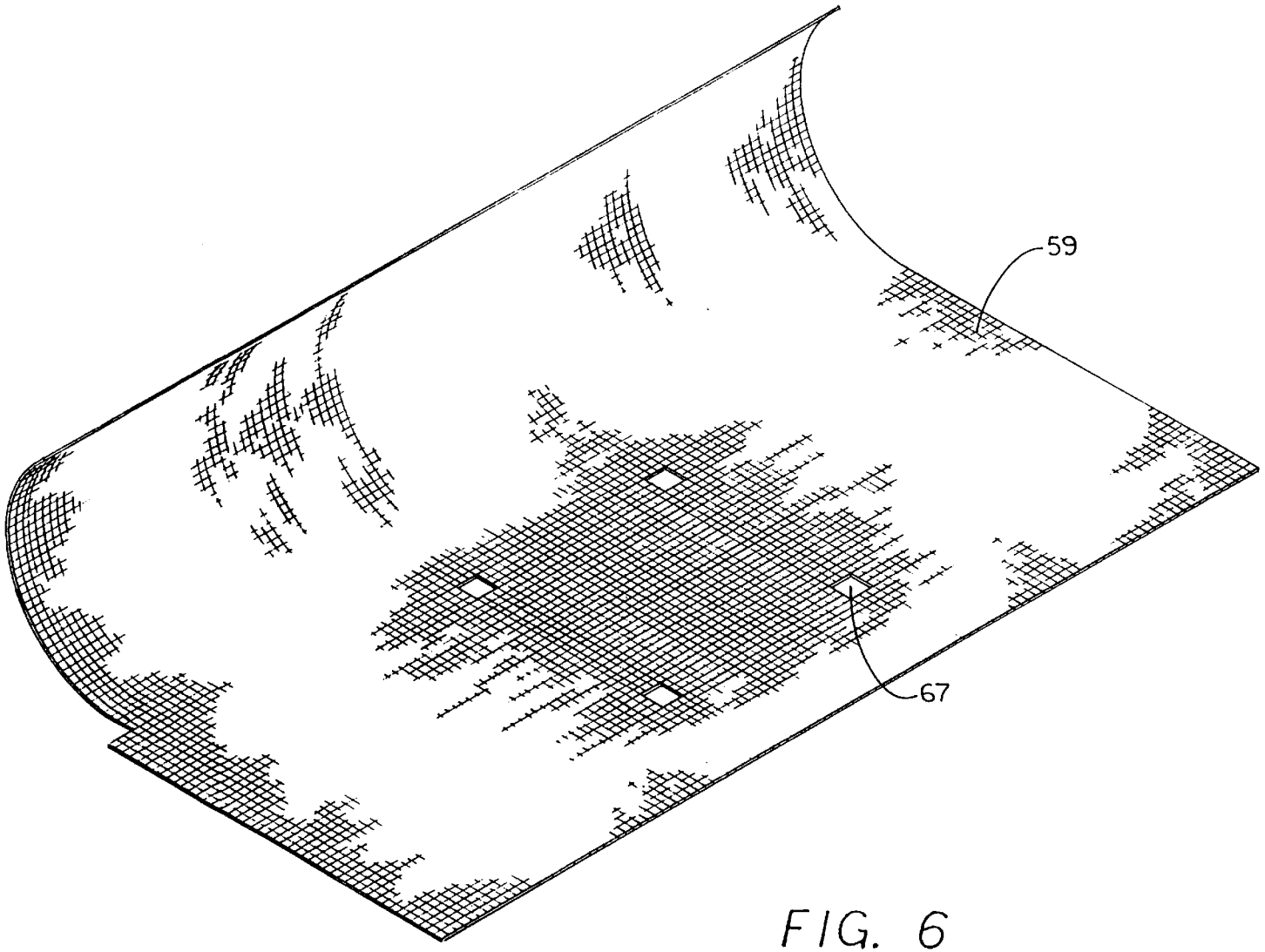
FIG. 6 is a perspective view of a portion of the dust controlling work station.
Figure 7:
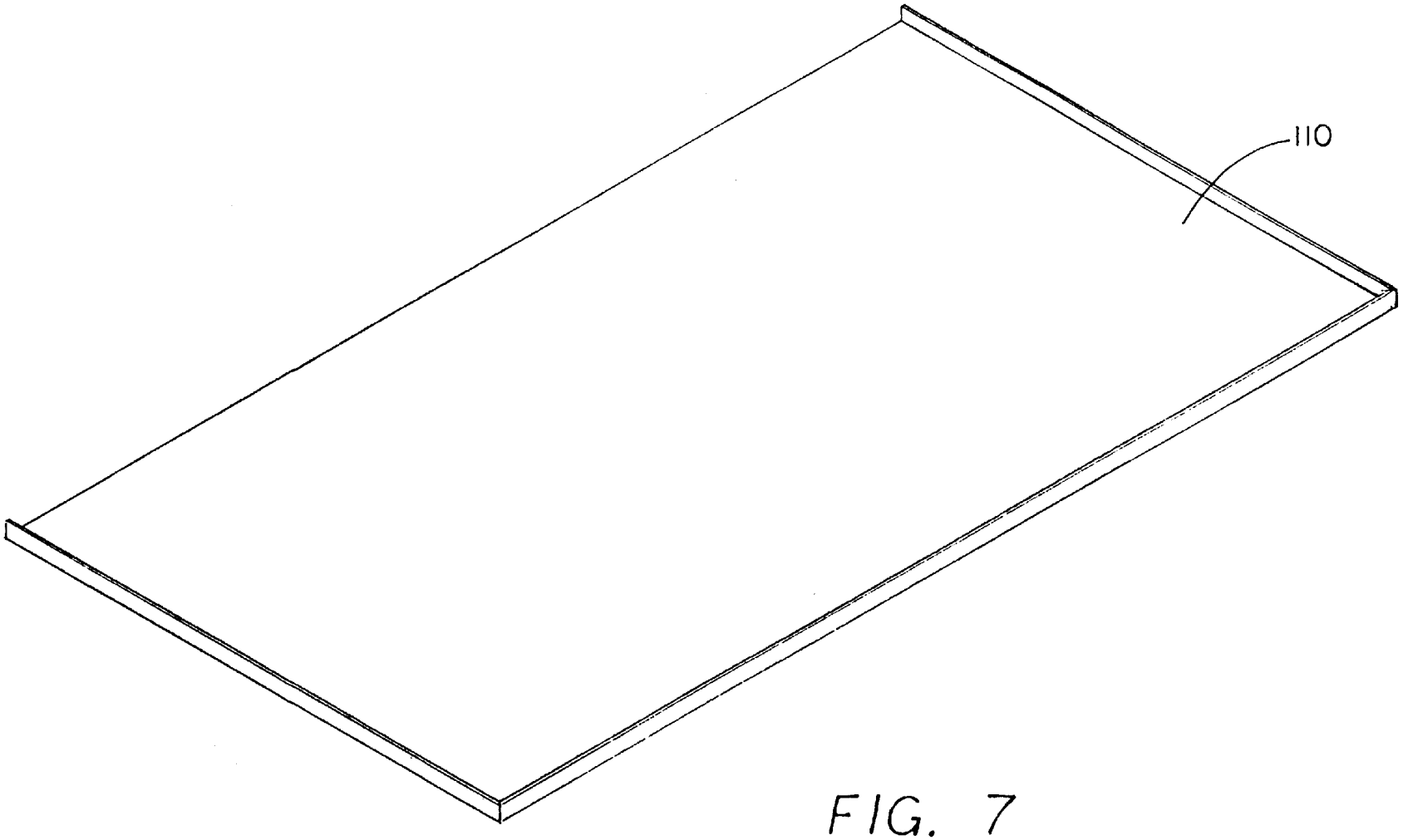
FIG. 7 is a perspective view of a portion of the dust controlling work station.
Figure 8:
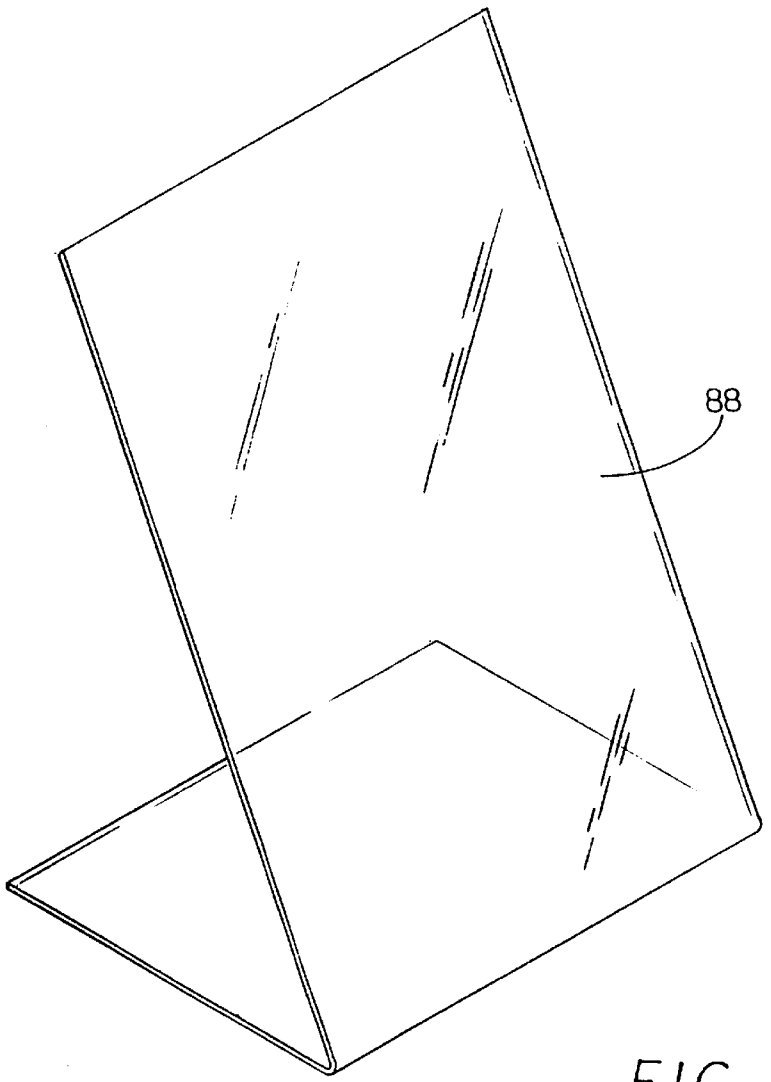
FIG. 8 is a perspective view of a portion of the dust controlling work station.
Figure 10:
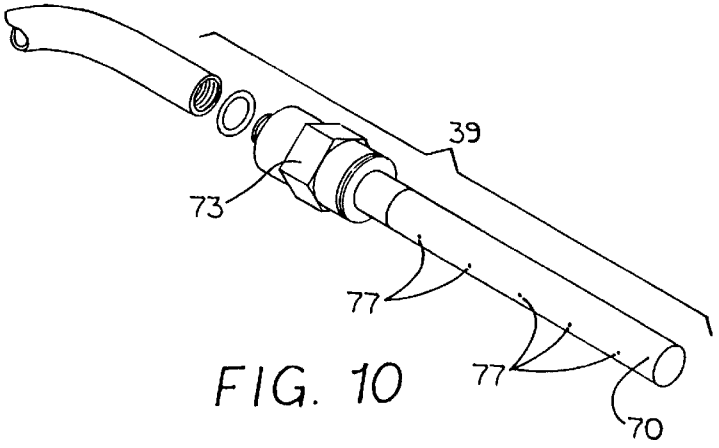
FIG. 10 is a perspective view of a portion of the dust controlling work station.
Figure 9:
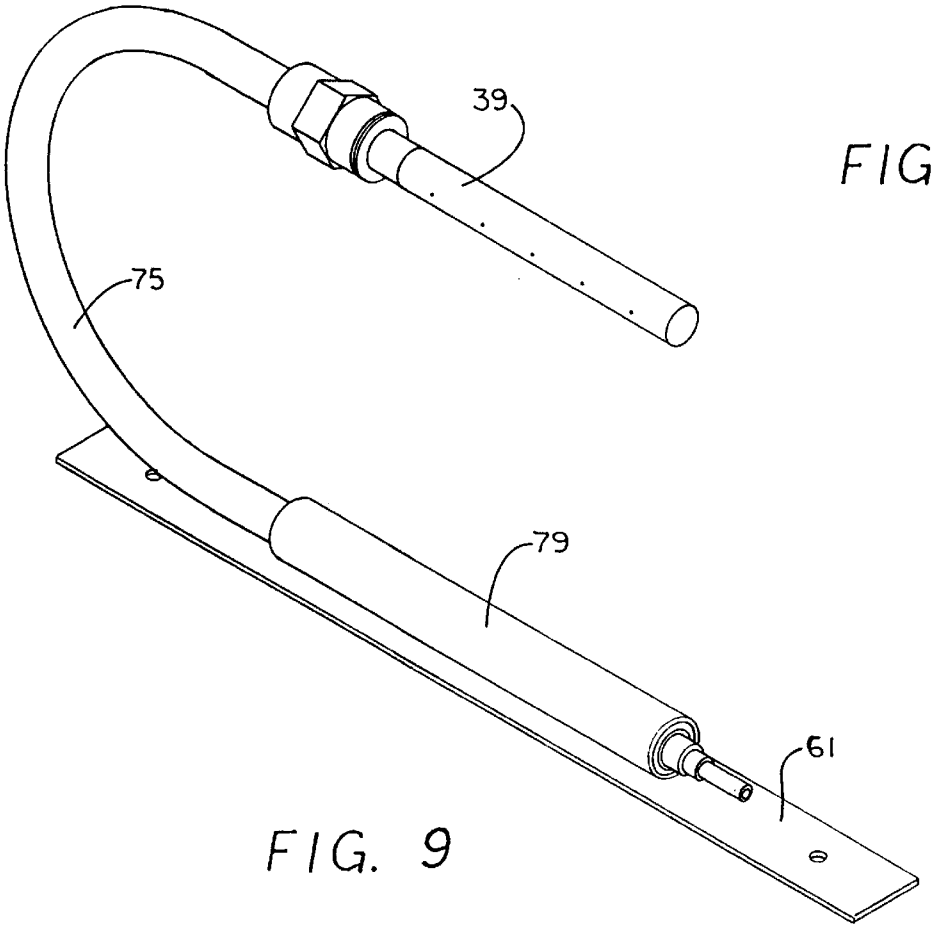
FIG. 9 is a perspective view of a portion of the dust controlling work station.
Figure 11:
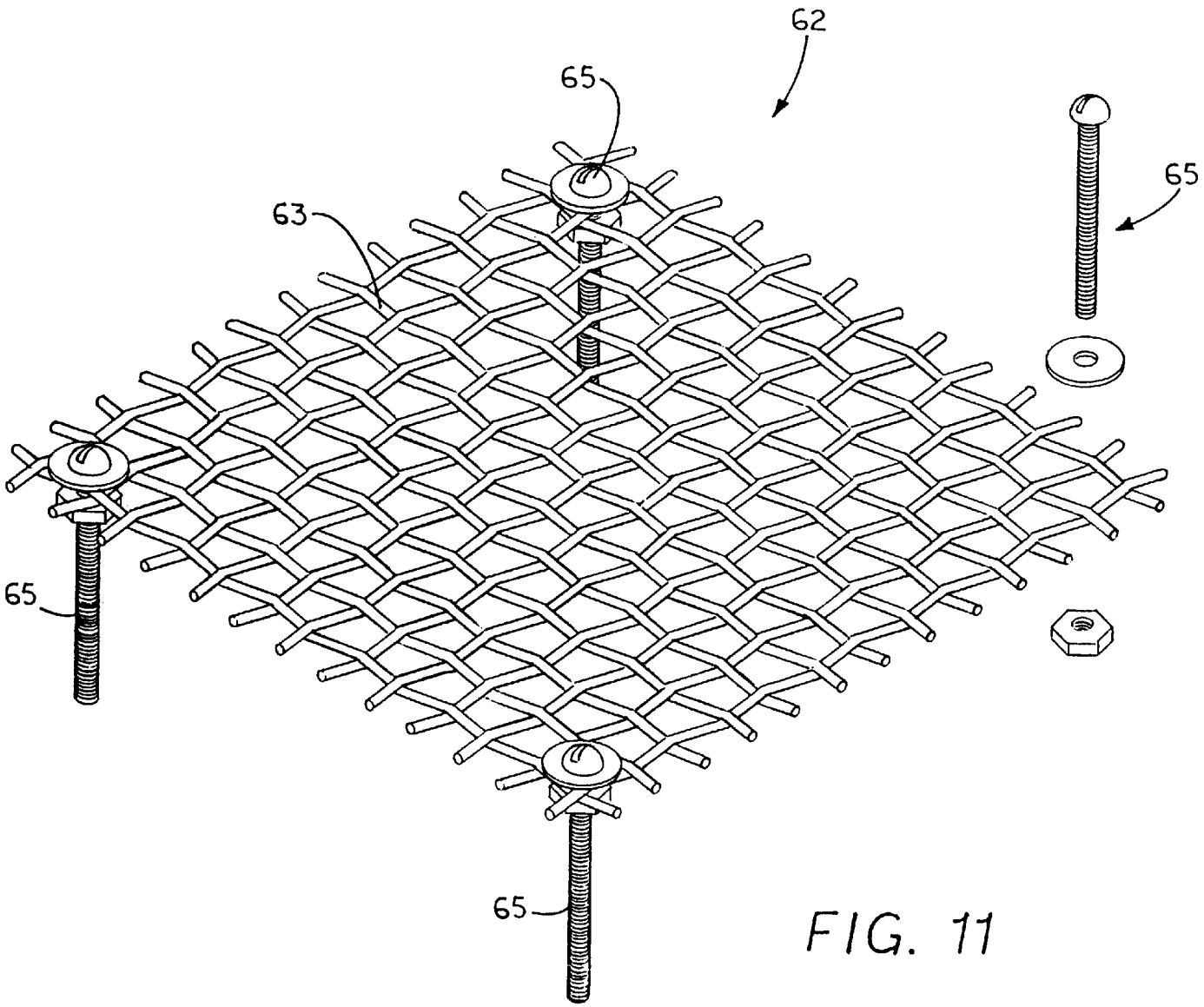
FIG. 11 is a perspective view of a portion of the dust controlling work station.

FIG. 5 shows a filter assembly 50 which includes the main filter media 44 enclosed in a filter frame 52 and sandwiched by a top screen 54 and a bottom screen 56. The filter assembly also includes a back edge 57 that preferably remains unframed, as shown in FIG. 2. Binder clips 58 are preferably utilized to maintain the sandwiching configuration of the top screen and the bottom screen in relation to the main filter media, while allowing air flow and particulate material to easily fall out of the filter assembly. As an alternative to binder clips, wire ties or staples could be employed to maintain the sandwich along the back edge of the filter assembly. Also alternatively, the back edge of the filter assembly can be framed, but preferably offset from the back filter media 45. This offset provides the particulate material that falls out of the back filter media with a clear path to the settling tray 43.

Figure 16:
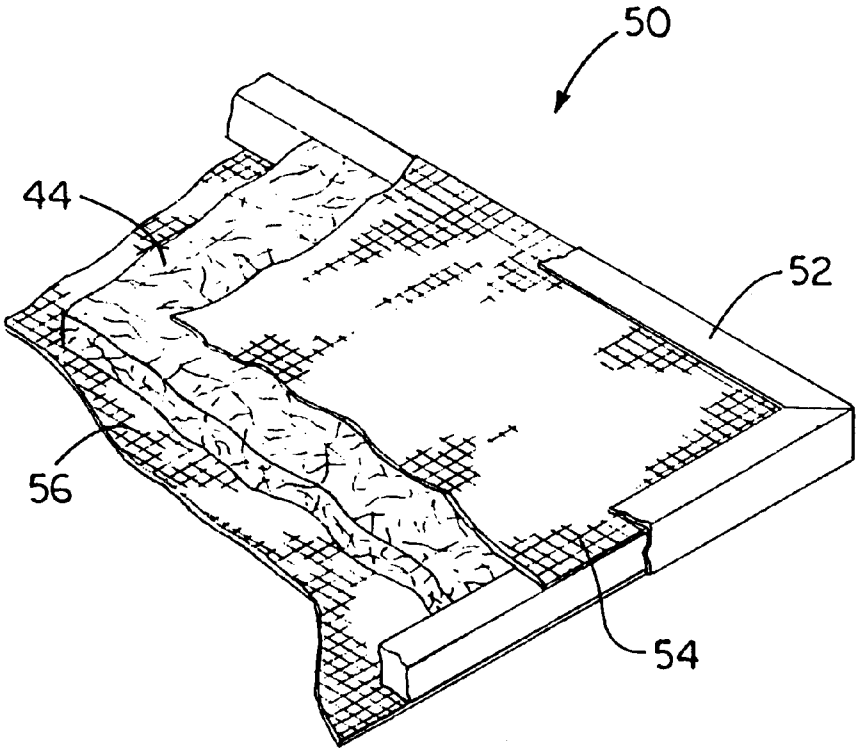
FIG. 16 is a sectioned perspective view of a portion of the dust controlling work station.

FIG. 16 details the layering of the filter assembly 50. The top screen 54 and the bottom screen 56 are preferably attached to the filter frame 52, with the main filter media 44 held within. The main filter media can be easily removed by sliding the main filter media out of the collection base 25 as detailed in FIG. 2, for the recovery of any particulate material 36 trapped therein.

A work screen 59 is preferably included as a top layer over the filter assembly 50 of the collection base 25 and the back filter media 45 of the back shield 30. The work screen is preferably a resilient plastic, such as a coarse mesh of artist sheet plastic canvas, and is formed to curve from the collection base to the back shield as shown in FIG. 1. The work screen can be attached to the collection base 25 as shown in FIGS. 1 and 2, with screen screws 60 that clamp down the work screen with a frame strip 61. As also shown in FIGS. 1 and 2, the work screen can preferably extend past the frame strip to provide a rounded edge for the comfort of the user. Arm rests (not shown) can also be employed to provide support for the user's arms while using the dust collecting work station 25.

As also shown in FIGS. 1 and 2, a work platform 62 is preferably included in the present invention to provide a solid working surface for the user. The work platform is centrally positioned on the collection base 25. The work platform is detailed in FIG. 11 and includes a platform screen 63 and corner pillars 65. The platform screen is preferably formed from a strong metal mesh material, and most preferably a woven grid of brass wire. The corner pillars raise the screen of the work platform above the work screen 59 to provide a stable platform for performing the desired work operations by the user.

As shown in FIG. 5, the filter assembly 50, including the main filter media 44, the bottom screen 56 and the top screen 54, all include a work platform penetration 66, there through. The work platform penetration receives the work platform 62, after the filter assembly is inserted into the collection base 25. Additionally, the work screen 59 preferably includes pillar penetrations 67 for receiving the corner pillars 65 of the work platform.

As discussed above, nozzles are utilized in the present invention, to direct and concentrate the positive pressure air flow 37 into the work area and specifically direct the positive pressure air flow to the work platform 62. The back nozzle 38 can be mounted proximate to the back shield. Preferably, the back nozzle is mounted upon the back shield, and most preferably mounted on the top edge of the back shield, as shown in FIG. 1.

Alternatively or in tandem with the back nozzle 38, a front nozzle 39 can be utilized in the present invention. The front nozzle is located proximate to the face of a user. Preferably, as shown in FIGS. 1 and 2. the front nozzle extends upward from the front edge 27 of the collection base 25. As detailed in FIGS. 9 and 10, the front nozzle preferably includes a front aerator 70 attached to a bushing 73, which connects the front aerator to a riser tube 75. The front aerator includes a plurality of orifices 77 to direct and distribute air flow out of the front aerator. The riser tube preferably connects to a front mount 79, which preferably attaches to the frame strip 61 along the front edge of the collection base. The front mount is then connected to the air supply line 42 that carries pressurized air from the regulator 40.

Figure 3:
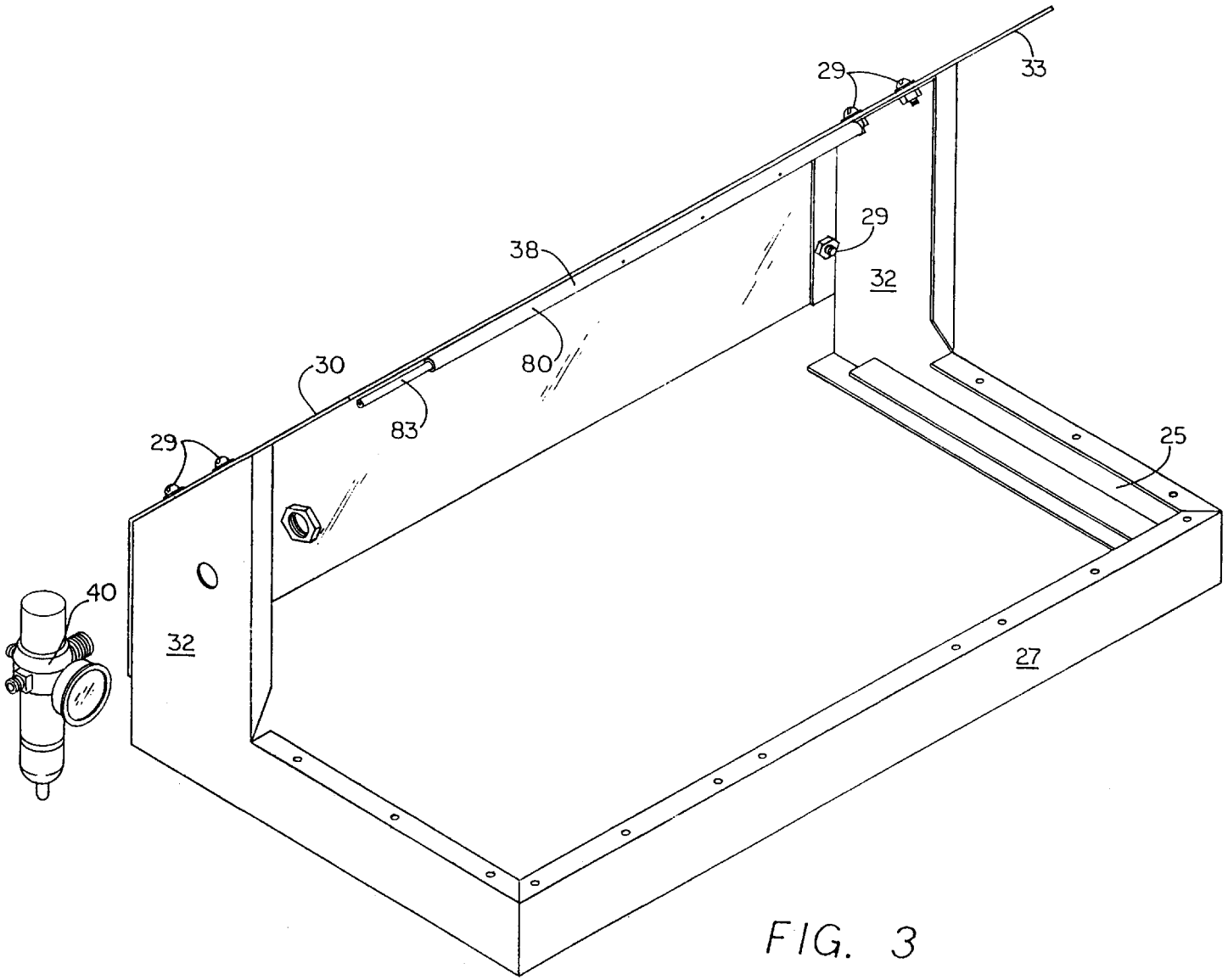
FIG. 3 is a perspective view of a portion of the dust controlling work station.

Similarly, the back nozzle 37, as shown in FIGS. 1 through 3, preferably includes a back aerator 80 attached to a sleeve 83, which connects the back aerator to the air supply line 42 that carries pressurized air from the regulator 40. Like the front aerator 70, the back aerator also includes a plurality of orifices 77 to direct and distribute air flow out of the back aerator. The back aerator can be mounted to the top edge 33 of the back shield 30 with silicon-based caulking, as preferred.

Figure 4:
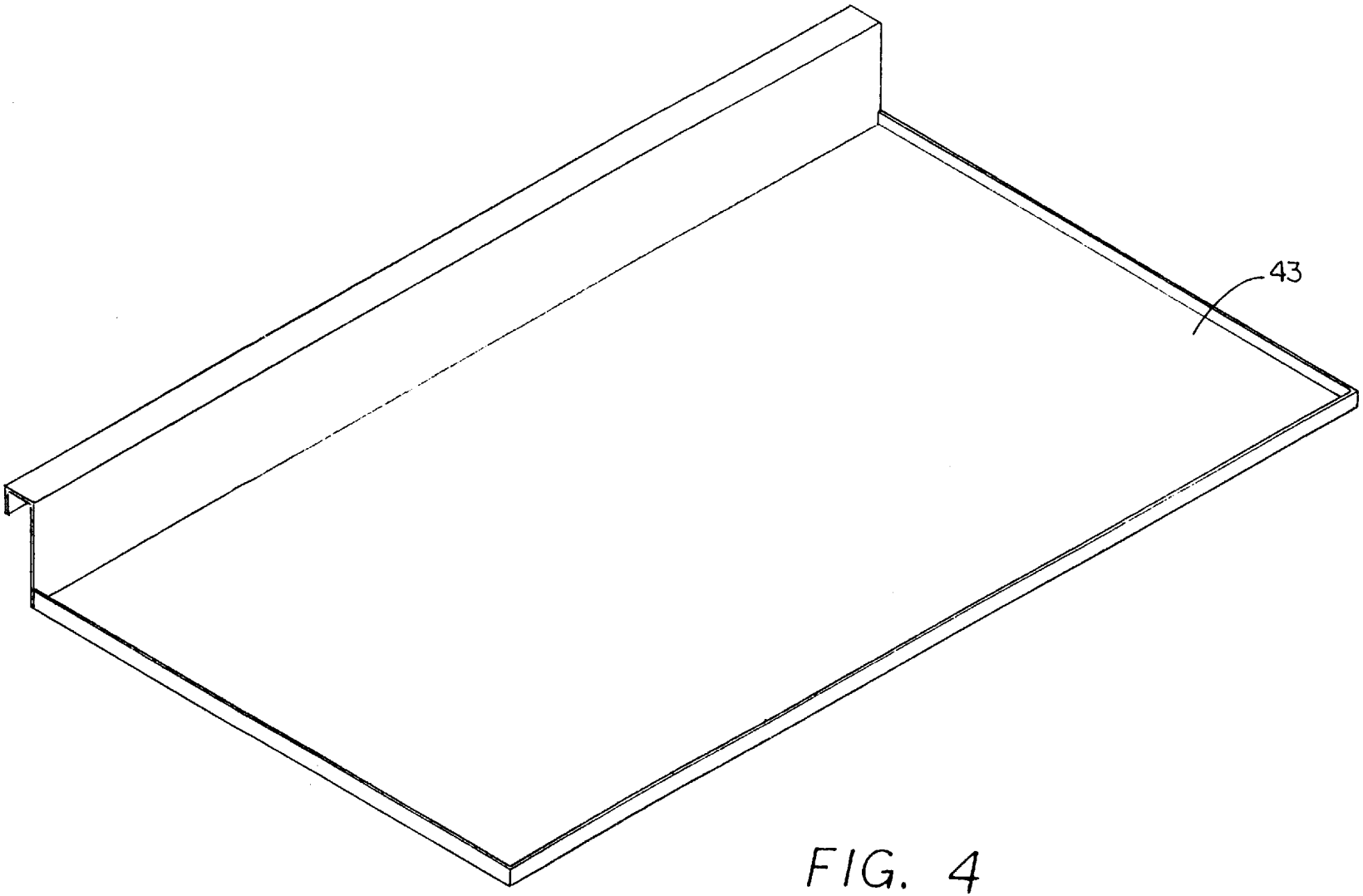
FIG. 4 is a perspective view of a portion of the dust controlling work station.

To collect the suspended particulate material 36 knocked down into the back filter media 45 and the front filter media 44 by the positive pressure air flow 37 from the front nozzle 39 and the back nozzle 38, the settling tray 43 is preferably employed. As shown in FIGS. 2 and FIG. 4, the settling tray is located proximate to and preferably below the collection base 25. Like the collection base, the settling tray is also preferably formed from light gauge sheet metal and is preferably shaped as detailed in FIG. 4. The settling tray collects the particulate material entrained by the filter media. As also preferred, the filter assembly 50 is located upon the settling tray, as shown in FIG. 2. The settling tray, positioned below the filter assembly, collects the particulate material without disturbance from the air supplied by the back nozzle or the front nozzle, above.

In removing the particulate material 36 from the work area 35 and also serving to provide particulate free air into the work area, the positive pressure air flow 37 from the front nozzle 39 and the back nozzle 38 combine to minimize the potential inhalation of the particulate material by the user. Additionally, a face shield 88 is preferably utilized with the present invention to further deflect particulate material away from the user. FIGS. 1 and 2 show the face shield used with the dust collecting work station 20, while FIG. 8 details the preferred form of the face shield. As preferred, the face shield is manufactured from a material that is preferably shatter proof and scratch resistant, such as plexiglass or lexan.

The user of the present invention can control the positive pressure air flow 37 with the aid of a foot control pedal 90, as shown in FIG. 1. The foot control pedal is preferably placed in the air supply line 42 prior to the regulator 40 and is most preferably located on the floor below the work area of the dust collecting work station, where it can be activated by a foot of the user.

The foot control pedal 90 and its component parts are detailed in FIGS. 12 through 15. The foot pedal includes a top plate 92 and a base plate 94. A foot valve 95 is preferably attached to the base plate. The foot valve interrupts the air supply line 42 and allows the positive pressure air flow 37 to pass through the foot valve whenever a plunger 97, at the interface between the base plate and the top plate, is depressed.

Figure 14:
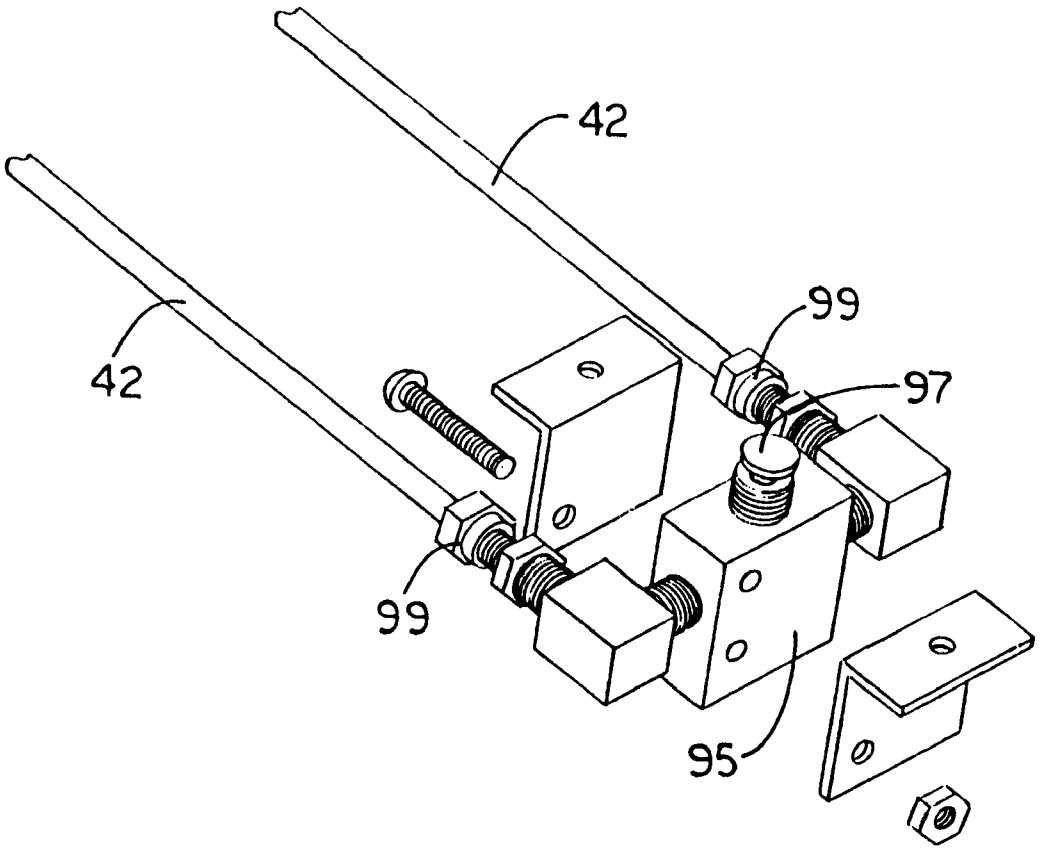
FIG. 14 is a perspective view of a portion of the dust controlling work station.

FIG. 14 details the foot valve 95 and shows the air supply line 42, a pair of air connections 99 to the foot valve and the plunger 97. The foot valve can be any appropriate low pressure pneumatic valve, however a "TAC$^2$" type valve, model "31P", as manufactured by Humphrey® of Kalamazoo Mich., U.S., is most preferred.

Figure 12:
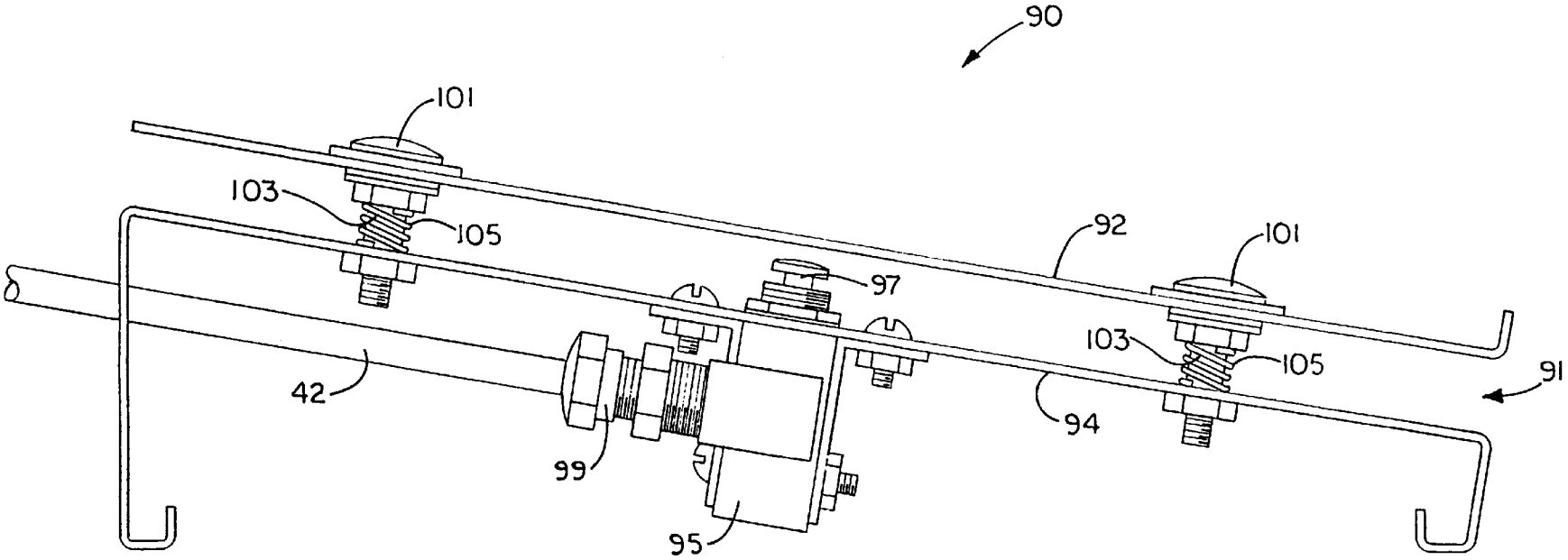
FIG. 12 is a side view of a portion of the dust controlling work station.

The foot control pedal 90 is normally in the position as shown in FIG. 12, which details the foot control pedal in an "off" or deactivated position 91. When the user's foot pressure is applied to the foot pedal, the top plate 92 is depressed to push in the plunger 97, as shown in FIG. 14, which details the foot control pedal in an "on" or activated position 93.

Figure 13:
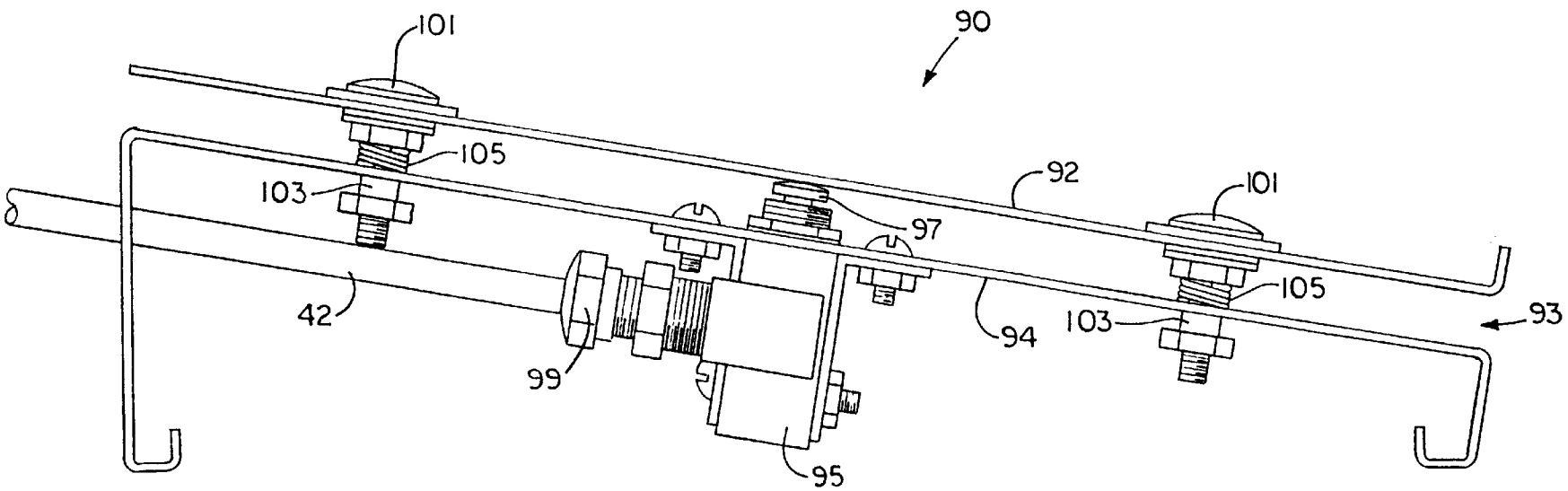
FIG. 13 is a side view of a portion of the dust controlling work station.
Figure 15:
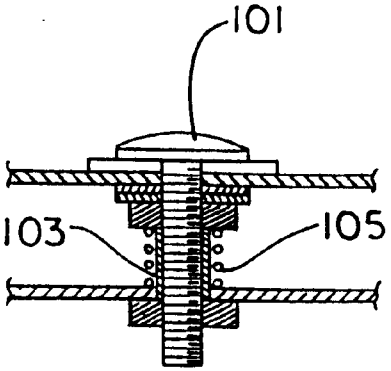
FIG. 15 is a partially sectioned side view of a portion of the dust controlling work station.

The top plate 92 is preferably connected to the base plate 94 of the foot control panel with four plate screws 101. FIG. 15 shows a detail of one of the four plate screws. A spacer 103 separates the top plate 92 from the base plate 94 and is held in the deactivated position 91 by a spacer spring 105. The four plate screws are each received through the spacer and travel through the bottom plate when the top plate is in the depressed position 93, as shown in FIG. 13.

An additional feature of the foot control pedal 90 is that the foot control pedal is designed to be employed for placement beneath the foot control of a user's hand tool (not shown). This "piggyback" configuration allows the user to operate the positive air flow for knocking down particulate material 36, whenever the user's hand tool operates, which is how the particulate material is first generated, as the user grinds or in some similar way operates upon a work piece. The top plate 92 of the foot control pedal can also include a non-slip pad (not shown), for maintaining the position of the user's hand tool control.

To further contain the collection base 25, the filter assembly 50 and the settling tray 43 of the dust collecting work station 20, a table tray 110 is preferably utilized. The table tray is shown in FIGS. 1 and 2 as providing a lipped containment for the collection base and thereby provides a further collection area for dusts and fines of the particulate material 36 collected. The table tray is detailed in FIG. 7 and is preferably formed from a light gauge of a sheet metal. Additionally, the table tray provides a base platform for the dust collecting work station.

The operation of the dust collecting work station 20 is simple and efficient. In a preferred method of utilizing the invention, a work area 35 is provided that is at least partially enclosed. Then, a particulate material 36 is generated within the work area by the user. This particulate material is generated from a grinding, deburring or a similar material processing operation by the user on a metallic or ceramic object.

As the particulate material 36 is generated by the user, a positive pressured air flow 37 is utilized to impact the particulate material. This impacted particulate is knocked into a filter media, positioned either in a filter assembly 50, below the work area 35 or in a back filter media 45 located on the back shield 30. The particulate material then falls out of the filter media and collects in the settling tray 60. The user can then slide out the settling tray and recover the particulate material.

In compliance with the statutes, the invention has been described in language more or less specific as to structural features and process steps. While this invention is susceptible to embodiments in different forms, the specification illustrates preferred embodiments of the invention with the understanding that the present disclosure is to be considered an exemplification of the principles of the invention, and the disclosure is not intended to limit the invention to the particular embodiments described. Those with ordinary skill in the art will appreciate that other embodiments and variations of the invention are possible which employ the same inventive concepts as described above. Therefore, the invention is not to be limited except by the following claims, as appropriately interpreted in accordance with the doctrine of equivalents.

What is claimed is:

1. A dust collecting work station, which comprises:

a collection base;

a back shield positioned approximately above the collection base;

a work area within the back shield and the collection base;

a positive pressure air flow supplied to the work area for removing a particulate material from the work area; and a filter media positioned proximately to the collection base for trapping the particulate material.

2. A dust collecting work station, which comprises:

a collection base;

a back shield positioned approximately above the collection base;

a work area partially enclosed by the back shield and the collection base;

a positive pressure air flow supplied to the work area for removing a particulate material from the work area by impacting the particulate with the positive pressure air flow; and a filter media positioned proximately to the collection base for trapping the particulate material.

3. The dust collecting work station of claim 2, wherein the positive pressure airflow is supplied by a nozzle located proximate to the front of the collection base.

4. The dust collecting work station of claim 2, wherein the positive pressure airflow is supplied by a nozzle located proximate to a face shield, the face shield located proximate the front of the dust collecting work station, and the face shield for protecting a user of the dust collecting work station.

5. The dust collecting work station of claim 2, wherein the positive pressure airflow is supplied by a nozzle located proximate to the back shield.

6. The dust collecting work station of claim 2, further comprising a settling tray located proximate to the collection base, and wherein the filter media is located over the settling tray.

7. The dust collecting work station of claim 2, further comprising a foot pedal for controlling the positive pressure airflow to the work area.

8. The dust collecting work station of claim 7, wherein the foot pedal also controls a hand tool.

* * * * *